United States Patent [19]

Ball

[11] Patent Number: 4,662,608

[45] Date of Patent: May 5, 1987

[54] AUTOMATIC DRILLING CONTROL SYSTEM

[76] Inventor: John W. Ball, Rte. 2, P.O. Box 89, Venus, Tex. 76084

[21] Appl. No.: 653,142

[22] Filed: Sep. 24, 1984

[51] Int. Cl.[4] ..... B66D 1/48; E21B 19/00

[52] U.S. Cl. ..... 254/273; 175/27; 175/162

[58] Field of Search ..... 175/24, 26, 27, 162, 175/170, 189, 195, 202, 203; 173/6; 254/273, 272

[56] References Cited

U.S. PATENT DOCUMENTS

| | | | |
|---|---|---|---|
| 2,867,411 | 1/1959 | Simmonds et al. | 254/273 |
| 3,759,489 | 9/1973 | Jones | 254/273 |
| 4,046,355 | 9/1977 | Martin | 254/273 |
| 4,519,585 | 5/1985 | Furrow | 254/273 |

*Primary Examiner*—Stuart S. Levy
*Assistant Examiner*—David Werner
*Attorney, Agent, or Firm*—Mosely, Neal J.

[57] ABSTRACT

An automatic drilling control system is disclosed for a conventional drilling apparatus and rig having a drill line rolled up or fed off the drum during drilling by the engine and extending through a crown block and traveling block to a fixed point providing a dead line. The crown block and traveling block form a pulley system for supporting a drill pipe during drilling. A weight indicator gauge on the drilling console is hydraulically actuated from a pressure sensor connected to the dead line. A conventional brake drum controls the rate of feed out of the drill line to determine the tension of the dead line. A double-acting, fluid-actuated cylinder and piston connected to the brake handle positively move it to control the brake force on the drum. A three-way electric solenoid valve controls the application of pressurized fluid selectively to the piston in response to a pressure transducer in the hydraulic line from the pressure sensor. This provides a very close control of bit weight and provides greater drilling speed and greater uniformity of drilling operation. The apparatus may be supplemented with controls which operate the brake in response to overspeed of the drum or in response to close approach of the traveling block to the crown block to apply a braking force to stop the apparatus and prevent damage.

19 Claims, 9 Drawing Figures

AUTOMATIC DRILLING CONTROL SYSTEM

BACKGROUND OF THE INVENTION

1. Field of the Invention

This invention relates to new and useful improvements in earth drilling apparatus and more particularly to an improved system of control for earth drilling apparatus by controlling the application of braking force to the drum which feeds out the drill line and controls the lowering of the drill pipe during the drilling operation.

2. Brief Description of the Prior Art

In earth drilling, particularly the drilling of oil and gas well, the control of the drilling operation has usually been accomplished manually. In a conventional drilling rig, there is a draw works which is powered by an engine and operates most of the motor driven portions of the rig. The draw works has a drum with a drill line wound on it which is fed off to lower drill pipe as the drilling is accomplished. The drill line is looped through a crown block and a traveling block in a double pulley relationship and the end of the line is connected to a fixed point and called the deadline.

As the pipe is lowered into the well during drilling, the weight of the pipe string on the drill bit is measured by the tension in the drill line. The tension in the drill line is commonly measured by a pressure sensor which converts tension to weight indication through a hydraulic line extending to a bit weight gage on the drilling console. The rate of feed out of the drill line from the drum controls the bit weight and to a large extent the rate of drilling. The rate of feed out of drill line from the drum is controlled by a hand brake operated by a conventional brake lever. In manually-operated drilling rigs the driller has to monitor the operation of the equipment and operate the brake from time to time in response to the indications of the bit weight gage to control the rate of feed out of the drill line and thus attempt to keep a fairly constant bit weight.

In recent years there have been developed a number of automatic drilling machines. These machines are automatic in the sense that they provide some form of automatic control over the equipment. The commercially available automatic drillers have been marketed under the names BEAR, NATIONAL, STEWART AND STEVENSON, and SATELLITE. These automatic drillers operate from the air supply of the drilling rig enroute to the drillers control station. The components involved are mainly air clutches with various types of air dump valves to exhaust used air. These devices which use up and exhaust compressed air that is needed in the operation of the drilling rig are considered wasteful of the compressed air which often has to be reused in order to keep the drilling rig going.

More recently, some automatic drillers have been introduced which operate from special weight or tension sensors which are connected into the dead line and which control the application of compressed air to various control valves or clutches. Again, these devices have been objected to by many drillers as being wasteful of compressed air and being mechanically inefficient. There have also been a rather large number of instances of mechanical failure which have led to the disconnection of many of the automatic drillers from rigs where they have been installed.

Several patents have been noted which do not disclose any of the aforementioned automatic drillers but which are somewhat relevant in that they disclose some form of control for a drilling operation.

Klima U.S. Pat. No. 3,593,807 discloses a mining blast hole drilling apparatus having a hydraulic mechanism for forcing the drill bit into the ground and a controlled system for adjusting the drilling operation the controlling hydraulic pressure applied to the drill string.

Bromell U.S. Pat. No. 3,609,919 discloses a system for controlling a mining or blast hole drill bit by sensing dead weight and controlling the application of pressure to the drill bit.

Dower U.S. Pat. No. 3,893,525 discloses a system for controlling a drilling operation having manual control at the rig and a remote controller for controlling the operation away from the rig.

Barron U.S. Pat. No. 3,917,230 discloses a well drilling control system using various load sensing and movement sensing transmitters to adjust the weight on the drill bit to compensate for movement of a barge or platform in an offshore drilling operation.

The aforementioned patents, and the commercially available automatic drillers described above, do not suggest a drilling control system which gives a substantially instantaneous and positive control of the bit weight by a positive control of the brake controlling the feed out of drill line from the drum on the draw warks.

SUMMARY OF THE INVENTION

One of the objects of this invention is to provide a new and improved automatic control system for oil and gas drilling rig.

Another object of this invention is to provide an improved control system for drilling rigs having a rapid and positive control of the bit weight of the drill string.

Another object of this invention is to provide an improved control system for a drill rig which operates substantially instantaneously in response to the sensed dead weight as measured from the dead line.

Still another object to this invention is to provide a new and improved system for drilling rigs in which the bit weight can be controlled to a very narrow range during the drilling operation.

Still another object to the invention is to provide an improved controlled system for a drilling rig which operates from the hydraulic line from the bit weight indicator to respond instantaneously to changes in sensed bit weight and through an electronic circuit, and an electric solenoid which controls the operation of a double acting piston, provides a positive action of the brake to control feed off of the drill line.

Other objects of this invention will become apparent from time to time throughout specification and claims as hereinafter related.

The aforementioned objects of this invention and other objects may be accomplished by a novel automatic drilling control system for a conventional drilling apparatus and a rig with a crown block and a traveling block, a draw works and an engine, a drum powered by the engine, clutches and controls, a drill line wound on the drum and rolled up or fed up during drilling by the engine. The drill line extends through the crown block and traveling block and is connected to a fixed point providing a dead line. The crown block and traveling block form a pulley system for supporting a drill pipe to raise or lower it during drilling. A weight indicator gage is provided on the drilling console adjacent to the other controls and is actuated by a hydraulic line from a hydraulic pressure sensor connected to the dead light to measure tension. The drilling apparatus has a conventional brake operated by a brake handle which operates on the drum to control the rate of feed out of the drill line to determine the tension on the dead line. In the control system for this conventional drilling apparatus, there is provided a double-acting, fluid-actuated cylinder and piston connected to the brake handle for positively moving it to control the brake force on the drum. A three-way electric solenoid valve which controls the supply of pressure of pressurized fluid to one end or the other of the double acting piston is controlled by a pressure transducer connected in the hydraulic line from the bit weight sensor. The transducer responds to pressure in the hydraulic line and thus measures directly the bit weight and controls the solenoid valve to operate the double acting piston one way or the other to control the application of brake force to the drum. This arrangement provides a very close control of bit weight and provides greater drilling speed and greater uniformity of drilling operation. The apparatus may be supplemented with controls which operate the brake in response to overspeed of the drum or in response to close approach of the traveling block to the crown block to apply a braking force to stop the apparatus and prevent damage.

DESCRIPTION OF THE PREFERRED EMBODIMENTS

Figure 2:
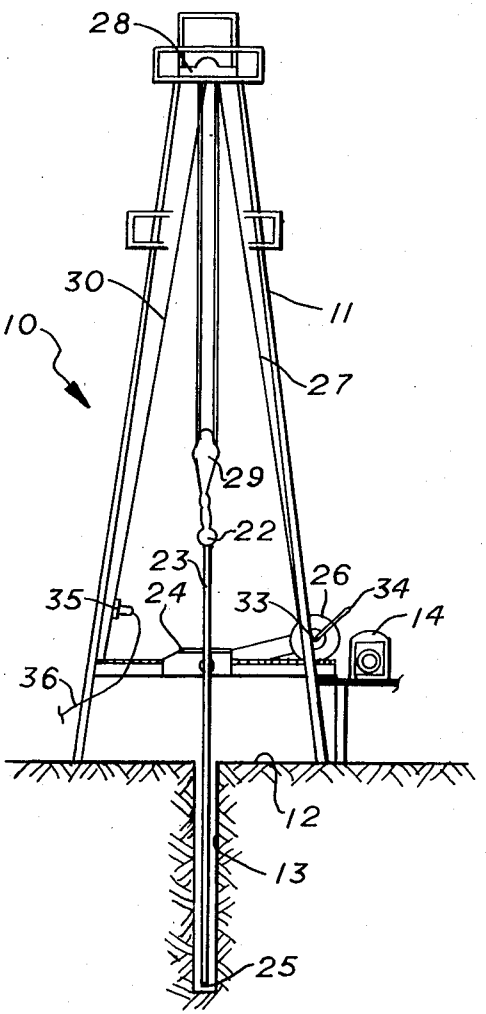
FIG. 2 is a view in elevation of the rig shown in FIG. 1 from a different angle showing the relationship of a hand brake which controls the feed off of the drill line for lowering the drill pipe during drilling operation.
Figure 1:
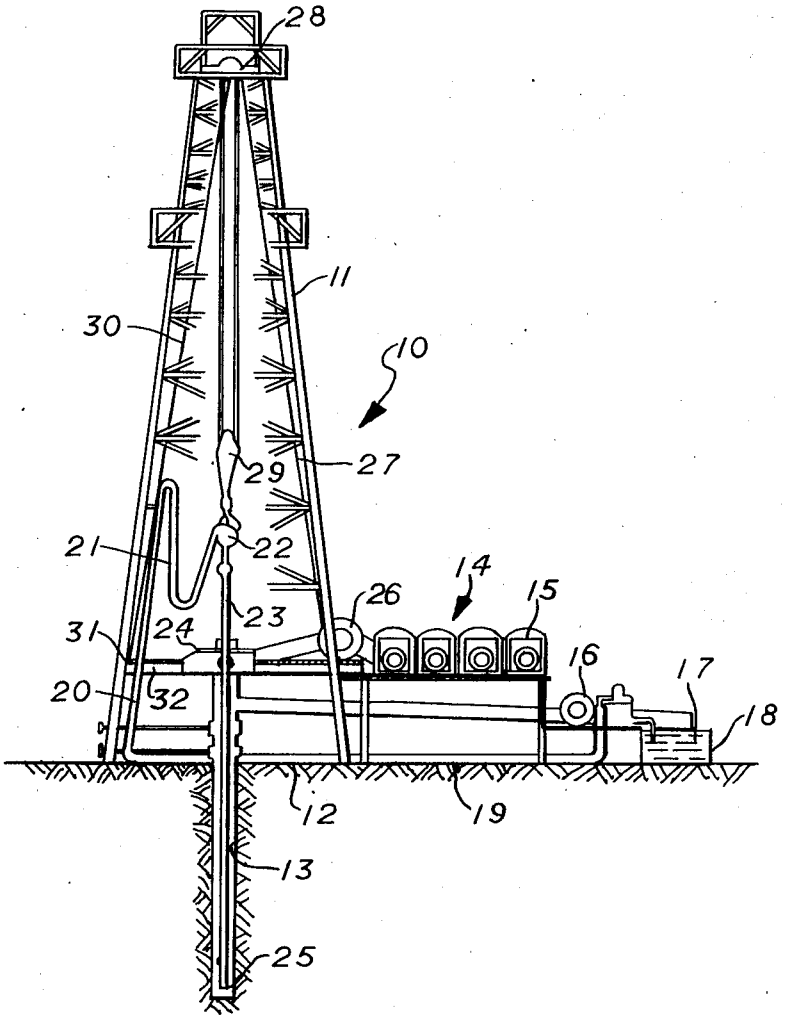
FIG. 1 is a somewhat schematic view in elevation of a drilling rig of more or less conventional construction.

Referring to the drawings by numerals of reference, and more particularly in FIGS. 1 and 2, there is shown a drill rig 10 and associated operating and control apparatus therefor. In FIG. 1, the drill rig 10 consists of a standard derrick 11 supported on the surface 12 of the earth above a hole 13 being drilled by the rig. Drill rig 10 has a draw works with a standard engine assembly 14 which operates a variety of the mechanical features of the equipment.

Engine 15 operates a slush pump 16 which supplies mud or other drilling fluid 17 from mud pit 18 through line 19 and stand pipe 20 connected by a flexible connection 21 to the swivel connection 22 at the upper end of the drill string. Drill pipe 23 extends from swivel 22 through rotary table 24 into drill hole 13 and has a conventional drill bit positioned at the lower end 25. Draw works 14 drives rotary table 24 to turn the drill string, consisting of a plurality of sections of drill pipe 23, and the drill bit at the lower end thereof. Draw works 14 also includes drum 26 which operated thereby. Drum 26 has a drill line 27 wound thereon. Drill line 27 is threaded through crown block 28 and through traveling block 29 in the relationship of a double pulley, or block and tackle, and has the end section 30 thereof or dead line connected to a fixed point 31 on the drilling platform 32.

In FIG. 2, is seen that drum 26 is provided with a brake 33 having a brake handle 34 for controlling the rotation thereof. Brake handle 34, in conventional, manually-operated systems, is operated manually by the driller to control the rate of rotation of drum 26 in feeding off the drill line 27. In the drilling apparatus shown in FIGS. 1 and 2, the weight of pipe 23 is measured by the tension of the drill line 27. The tension in the drill line 27 is measured by a hydraulic pressure sensor 35 connected on deadline 30 and having a hydraulic line 36 extending to a drill bit weight indicator gauge to be described below.

The rig and derrick construction and associated equipment described so far is standard drilling equipment and detailed information on its instruction and assembly an operation may be found in various API standards and also in various textbooks and manuals dealing with rotary drilling and equipment used in rotary drilling. The derrick described above is standard equipment and is normally of bolted construction and assembled part by part at the drilling site.

The arrangement of the crown block and traveling block is a block and tackle arrangement and is of conventional construction. The draw works which operates the drilling apparatus is a key piece of equipment on a rotary rig. The functions of the draw works are that it is a control center from which the driller operates the rig. The draw works contains controls, engine throttles, clutches, chains, sprockets and the like which enable rig power to be applied to selected operations. The draw works houses the drum which spools the drill line during hoisting operations and feeds off the drill line during drilling.

The engines used in the draw works may be of any suitable type including internal and external combustion engines and electric engines. The mud pumps are slush pumps driven by the draw works to circulate drilling fluid, i.e. mud, through the drill string and out through the drill bit and back up through the drill hole. The drilling mud cools the drill bit and carries cuttings away from the drilling area.

In normal operation of the standard, manually-operated drilling rig, the drum feeds off the drill line to lower the drill pipe to cause the drill bit to drill into the formation on which it rests. The weight on the drill bit is usually set at some selected level which is suitable for the conditions encountered at the bottom of the drill hole. The difference between the actual weight of the drill string and the desired bit weight will be registered on the bit weight indicator.

In drilling, it is necessary to keep the weight on the drill bit relatively constant and within a fairly narrow range to obtain efficient and rapid drilling. The maintaining of the bit weight at a constant value and within a very narrow range is virtually impossible to accomplish manually. There are simply too many tasks for the driller to do which keep him from attending the drum brake and the bit weight indicator closely enough to maintain the desired constant bit weight level. Because of this, there has been a great need for a satisfactory automatic drilling controller which can control bit weight rapidly and positively.

This invention, as shown in FIGS. 3 to 9, provides a system of automatic control for drilling rigs in which a rapid and positive control of the braking action on the drum feeding out the drill line controls the bit weight at a substantially constant value within a relatively narrow range. This control system works off the hydraulic line from the bit weight sensor on the dead line leading to the bit weight indicator gauge on the driller's console.

Figure 3:
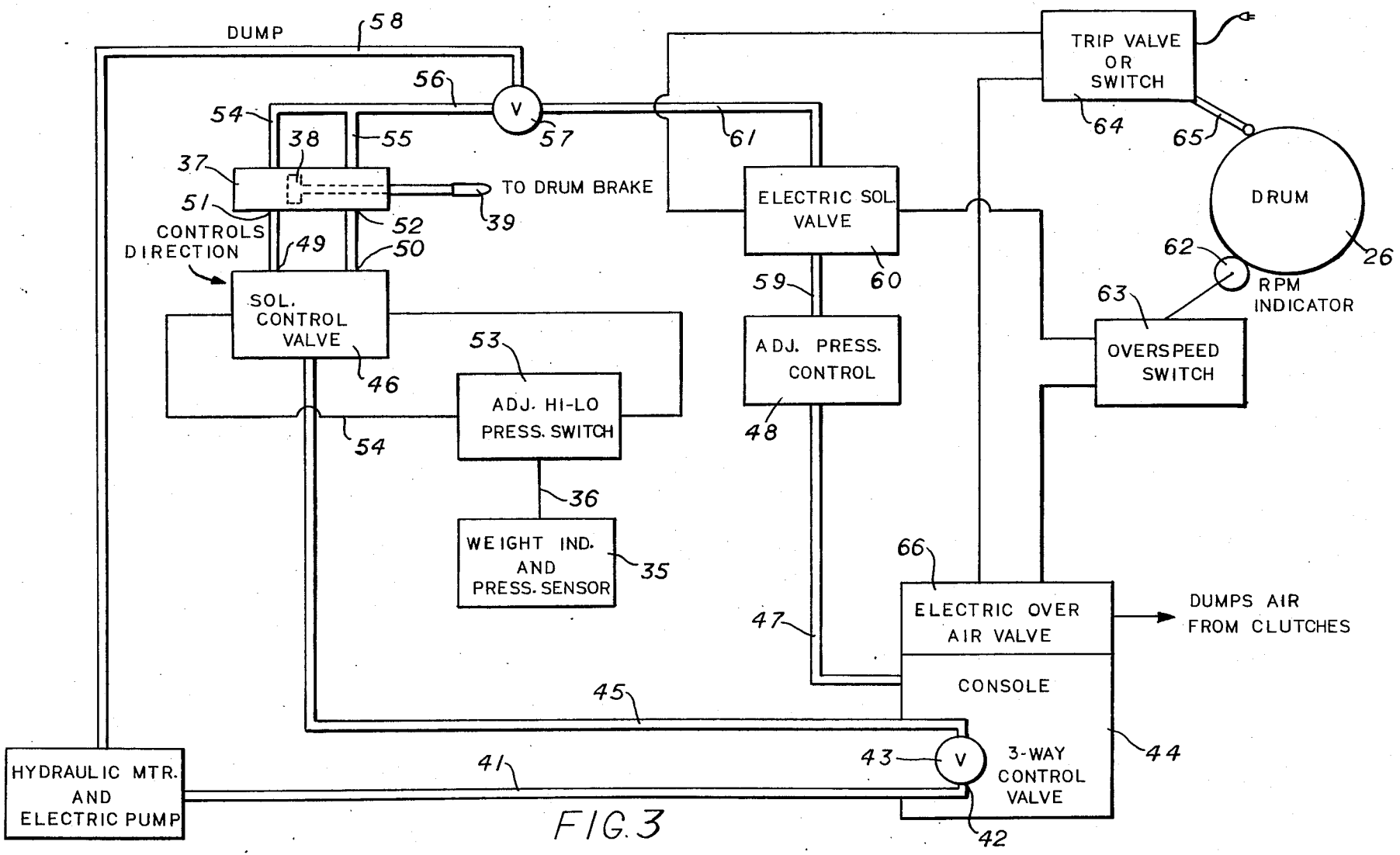
FIG. 3 is a schematic view of one embodiment of a control system for controlling the brake on the drum at the draw works of the drilling rig.

In FIG. 3, there is shown a schematic view or flow diagram of the control system. Drum 26 is shown schematically without the brake, although the brake is assumed to be present for control purposes. The system includes a cylinder 37 having a double acting piston 38 therein with a free end or operating end 39 which is positively connected to the handle of a drum brake. Movement of double acting piston 38 causes the drum handle 34 to moved accordingly and to apply or release braking force to the drum brake.

Cylinder 37 and double acting piston 38 is operated hydraulically in this embodiment of the invention, although it can be operated pneumatically if desired. The hydraulic circuit consists of hydraulic motor and electric pump 40 connected by line 41 to the inlet 42 of a three-way control valve 43 on the driller's console 44. One hydraulic line 45 extends to a three-way solenoid control valve 46. Another line 47 extends from three-way control valve 43 to adjustable pressure control 48. Solenoid control valve 46 has outlets 49 and 50 connected to ports 51 and 52 on opposite ends of cylinder 37.

Solenoid control valve 46 is controlled by an adjustable high-low pressure control switch 53 and associated power circuit 54 for energizing the solenoid coil (not shown) of solenoid control valve 46. Adjustable high-low pressure switch 53 is controlled by a pressure signal from the hydraulic line 36 of the weight indicator and pressure sensor 35. For safety reasons, the drum brake is spring-loaded to a braking position so that the equipment will fail safe in the event of power failure or other operational difficulty.

The energization of the coil for solenoid control valve 46 will adjust the valve to deliver hydraulic fluid (or compressed air) under pressure to a selected end of cylinder 37 to move double acting piston 38 either in a direction releasing the brake or in a direction applying additional positive braking force. Outlet lines 54 and 55 from cylinder 37 are connected to hydraulic line 56 leading to one side of control valve 57. An outlet line 58 from control valve 57 dumps hydraulic fluid pressure back to the hydraulic motor and electric pump 40.

The other side of the control circuit has a fluid pressure line 59 connecting adjustable pressure control 48 to electric solenoid valve 60. The other side of solenoid valve 60 is connected by line 61 to valve 57.

Drum 26 has an RPM indicator 62 and overspeed switch 63 associated therewith. A trip valve or switch 64 with sensor arm 65 is also controlled by drum 26. Trip valve or switch 64 is connected in an electric circuit with solenoid valve 60, overspeed switch 63 and an electric air valve 66 operable to dump air pressure from the air clutches.

The apparatus just described operates automatically in response to pressure indications from hydraulic line 36 of weight indicator and pressure sensor 35. Adjustable high-low pressure switch 53 responds to changes in pressure sensed from weight indicator and pressure sensor 35 to energize solenoid control valve 46 to control the application of hydraulic fluid pressure in one end or the other of cylinder 37.

If the bit weight drops, solenoid 46 is actuated to apply hydraulic fluid pressure to cylinder 37 to cause piston 38 to move to release the drum brake and allow the drill line to be fed off faster. If the bit weight sensed from hydraulic line 36 increases above the set range, solenoid control valve 60 will actuate double acting piston 38 to allow the drum brake to slow the feed off of drilling wire and further will apply a positive force to the brake handle to move it more firmly to a braking position.

Trip valve or switch 64 operates in response to irregularities in operation of drum 26, such as, vibration or the like. Overspeed switch 63 is responsive to excessive speed of rotation of drum 26 as measured by RPM indicator 62. Either of these controllers will open the circuit controlling air valve 36 and dump the air from the air clutches in the draw works and stop the positive rotation of the drum. At the same time, drum brake 33 is operated to bring the rotation of the drum to a complete stop. This control system is therefore operable to control the bit weight by controlling the braking force on drum 26 and thus controlling the rate of feed off of the drill line. The system also provides for emergency shut down for overspeed or other irregularities in operation of the drum. In addition, trip valve or switch 64 can be positioned to respond to movement of traveling block 29 to shut down the draw works if the traveling block 29 approaches crown block 28 too closely. This is essentially a "CROWN-A-MATIC" type of control.

Figure 4:
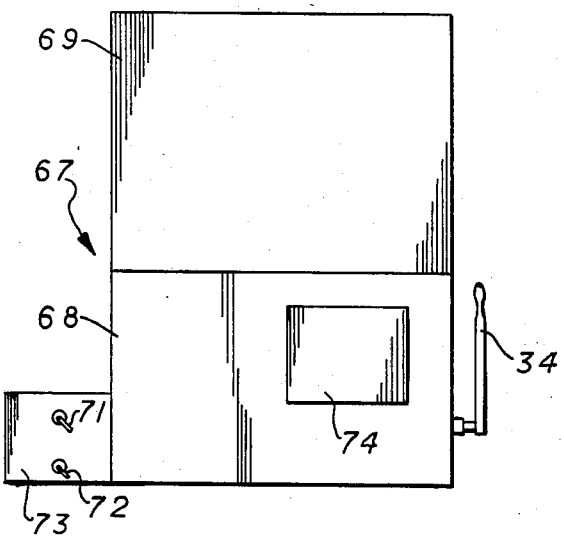
FIG. 4 is a view in front elevation of a drilling console or control panel showing the location of the brake handle for controlling the drum feeding out the drill line.
Figure 5:
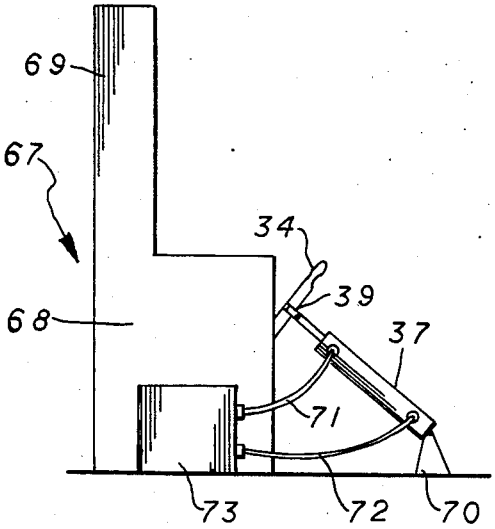
FIG. 5 is a view in side elevation of the drilling console shown in FIG. 4 with a control cylinder installed adjacent thereto with its piston connected to the brake handle.

Referring now to FIGS. 4 to 9, there is shown a preferred embodiment of the control system for drilling rigs which utilizes an electronic sensor and an electronic control panel for greater speed of response and positive control. In FIG. 4, there is shown a drilling console 67 having a base 68 and control panel 69. Brake handle 34 is shown mounted on the base 68 of console 67 and controls the application of brake pressure to brake 33 for drum 26. In this embodiment of the drilling control system, control cylinder 37 is mounted on a base or support 70 and has the end portion 39 of double acting piston 38 positively secured to brake handle 34 for operating the same. Brake handle 34 is spring loaded (spring not shown) toward a braking position so that any failure of the apparatus will be in a safe position.

Cylinder 37 is supplied with compressed air (or hydraulic fluid) through lines 71 and 72 extending from pressure control box 73. The electronic control system for the controller is housed in electronic control box 74 mounted on the front of the base portion 68 of console 67. The pressure control box 73 and electronic control box 74 are easily mounted on the existing drilling console 67 without any appreciable modification of the console.

Figure 6:
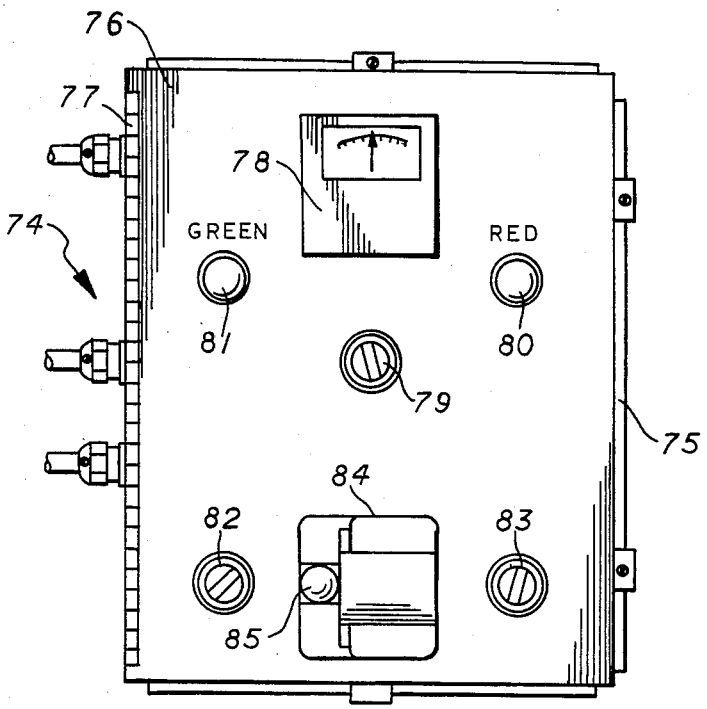
FIG. 6 is a view in front elevation, with cover closed, of the control panel for the automatic drill console.

In FIG. 6, there is shown a detail view in elevation of the exterior of control box 74. Control box 74 is a rectangular box 75 having a cover 76 hinged thereon as indicated at 77. The control circuit features of the electronic control box 74 are housed inside the box. On the cover 76 there is a zero meter 78 with zero adjustment switch 79. A red signal light 80 and a green signal light 81 are located on cover 76 just below zero meter 78. An on/off switch 82 controlling the application of power to the system is located at the lower left hand portion of cover 76. A switch 83 is positioned at the lower right hand side of cover 76 and provides for switching between automatic and manual operation of the drilling rig. An adjustable potential controller 84 having a rotatable operating lever 85 is positioned at the lower center of cover 76. The operating relationship of these various control features showing on the exterior of control box 74 will be understood more fully from the description of the control circuits shown described in FIGS. 8 and 9.

Figure 7:
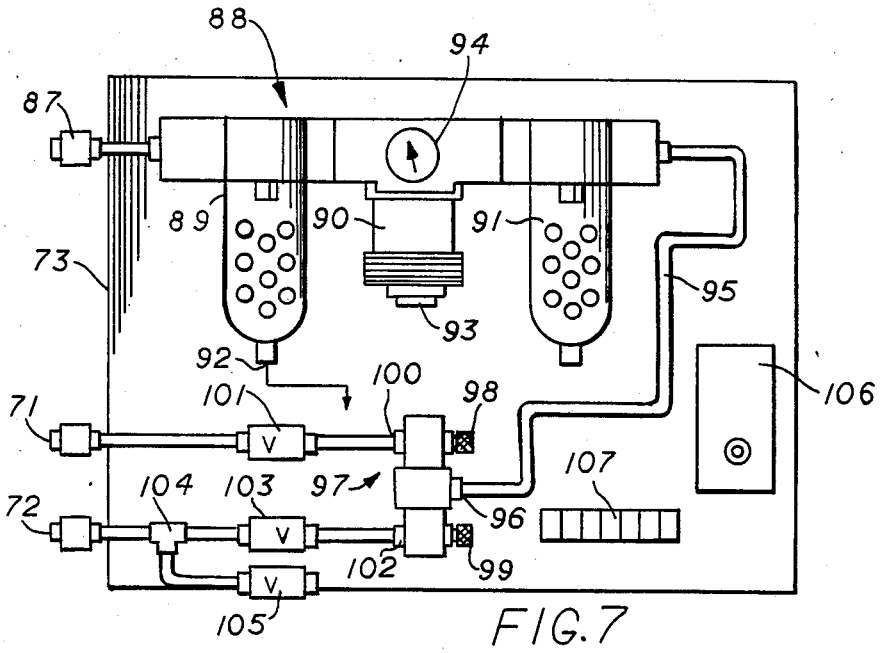
FIG. 7 is a somewhat schematic view of the compressed air control apparatus in the control box controlling the flow of compressed air to the cylinder and the piston for operating the brake handle.

FIG. 7 shows some of the details of pressure controller box 73. The pressure controller box 73 is shown with the cover removed and shows the relationship of the major components. An inlet connection 87 at the upper end of box 73 is for connection to the rig air system. Inlet connection 87 is connected to a unit 88 consisting of a filter/dryer combination 89, a regulator 90 and lubricator 91 connected in series.

Air filter/dryer 89 has a bottom drain 92 for removing water collected therein. Regulator 90 has a control knob 93 for adjusting pressure as read out on pressure gauge 94. An air line 95 is connected from lubricator 91 to the inlet opening 96 on three-way electric solenoid valve 97. The electric connection terminals for solenoid valve 97 are indicated at 98 and 99.

Outlet 100 from solenoid valve 97 is connected through needle valve 101 to outlet connection 71. Outlet 102 from solenoid valve 97 is connected to needle valve 103 which in turn is connected to outlet connection 72. A tee 104 in the connection from outlet connection 72 is connected to needle valve 105 to allow for venting the system. The electric connections for pressure control box 73 come in through power pack 106 and terminal block 107.

Figure 9:
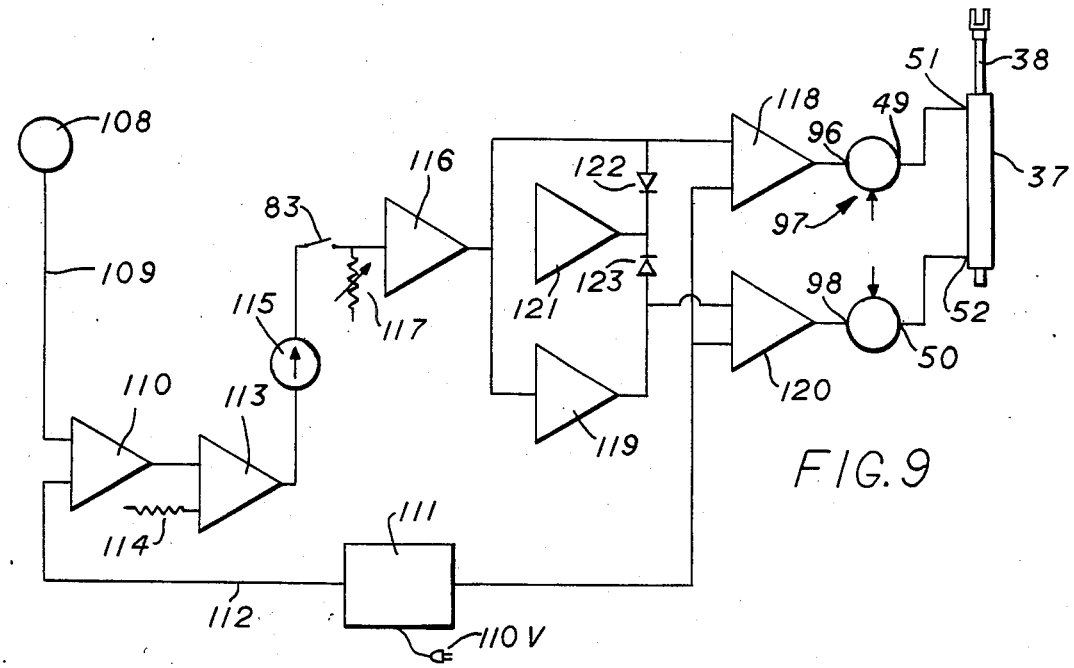
FIG. 9 is a schematic combined wiring and compressed air circuit diagram illustrating the connection of the apparatus in relation to the pressure transducer and the cylinder and double acting piston which positively moves the brake handle.

In FIG. 9, there is shown a schematic electronic wiring diagram in association with the connections to solenoid valve and the connections from the solenoid valves to the operating cylinder for the drum brake. Pressure transducer 108 is connected in the hydraulic line 36 from the pressure sensor 36. Pressure transducer 108 produces an electric output through electrical connection 109 to amplifier 110.

A power source 111 is connected to a 110V. power source and has an output of 12V. and lower for powering the various electronic components. Power source 111 is connected by electric lead 112 to amplifier 110. Amplifier 110 is connected to one side of a summation amplifier 113 having an adjustable potentiometer 114 connected thereto. The output from summation amplifier 113 is connected through the zero meter 115 to one side of the manual switch 82 which switches the system between automatic and manual control.

Switch 83 is connected to amplifier 116 which has an adjustable potentiometer 117 connected thereto. The output from amplifier 116 which has an adjustable potentiometer 117 connected thereto. The output from amplifier 116 is connected to an on/off switching circuit 118 and to an inverter circuit 119. Inverter circuit 119 is connected to one side of on/off switching circuit 120 another side of which is connected to and powered from power source 111. Oscillator 121 is connected through diodes 122 and 123 to lines leading to on/off switching circuits 118 and 120. The output from on/off switching circuits 118 and 120 is connected to electrical connections 96 and 98 on solenoid valve assembly 97.

Compressed air (or hydraulic fluid) for operating cylinder 37 and piston 38 passes out under the control of solenoid valve 97 through outlet connections 49 and 50 to inlet connections 51 and 52 on cylinder 37. This system, as described and shown in FIG. 9, is schematic and much of the electronic detail is not shown. To understand the electronic detail of the control circuits one must refer to FIG. 8. However, the schematic diagram shown in FIG. 9 sets forth the relationship between the control circuit, the pressure transducer, the solenoid valve and the operating cylinder and piston.

The pressure transducer 108 supplies an electric signal based on hydraulic pressure received from line 36 from the pressure sensor 35 leading to the bit weight indicator gauge. The electric signal is amplified and processed through the electronic circuits. When the bit weight, as indicated by hydraulic pressure from the hydraulic line 36 and measured by pressure transducer 108 exceeds a selected value the electric signal is processed through the electronic control circuits and off-/on circuits 118 and 120 to operate the upper valve portion of solenoid valve 97 to supply compressed air to upper inlet 51 and to move piston 38 in a direction applying a braking force to drum 26. Likewise, if the bit weight decreases below a selected value as measured through the pressure transducer the electric signal is processed and operates off/on circuit 120 to cause solenoid valve 97 to supply compressed air to inlet 52 on cylinder 37 and thus cause piston 38 to move the brake to release the braking action.

Figure 8:
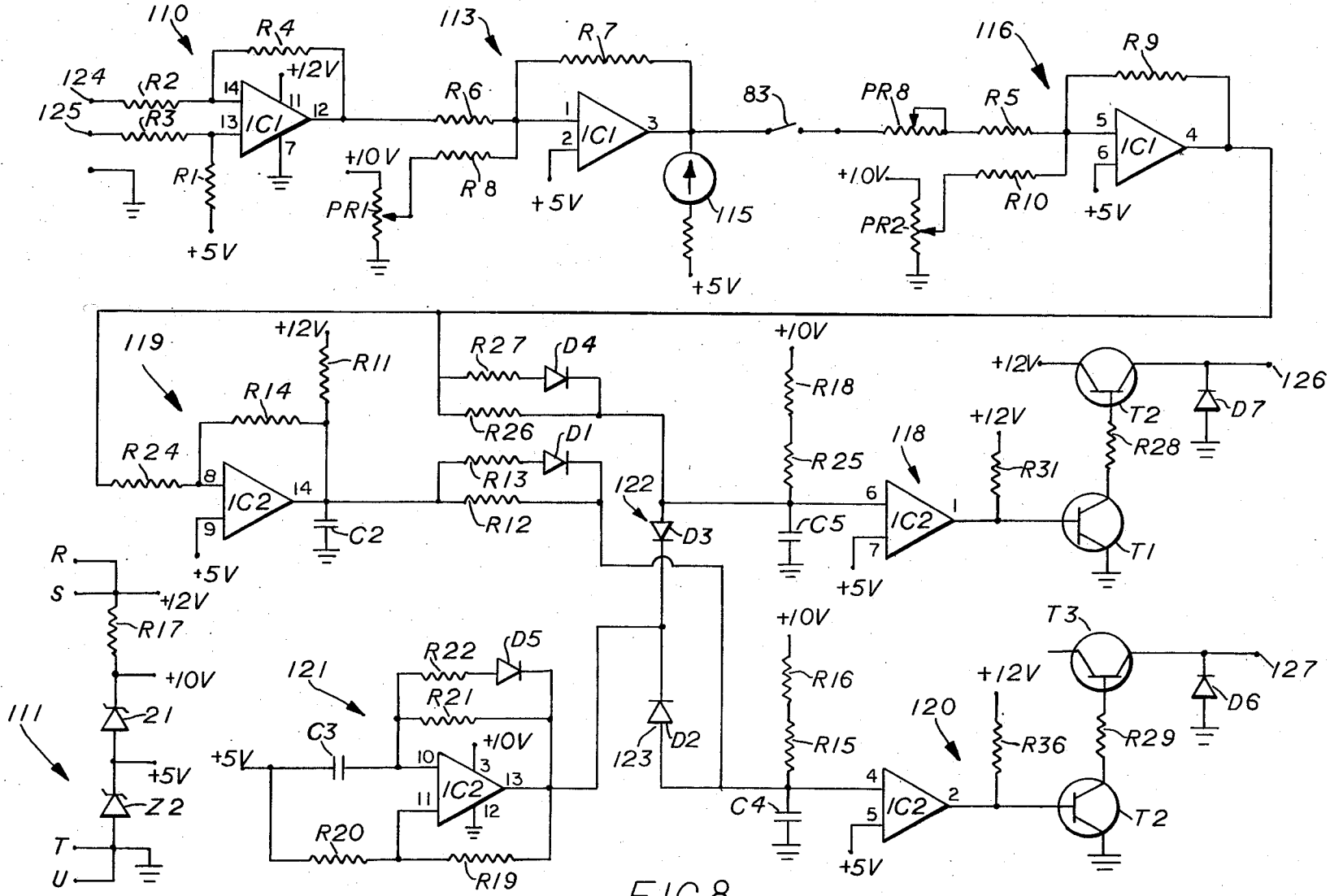
FIG. 8 is a control circuit diagram showing the electronic circuit responding to pressure signals from the pressure transducer and controlling operation of the solenoid valve which controls the supply of air to the double acting piston controlling the brake handle.

In FIG. 8, there is shown a more detailed electronic circuit diagram for effecting the various control functions discussed above. In the lower left hand corner of FIG. 8 there is shown a separate circuit which represents the power supply 111. This power supply includes terminals S and T which are connected to the 12 V. output and which includes the resistor R17 and zener diodes Z1 and Z2 and has output terminals connected for supply of 5 V., 10 V. and 12 V. output for operating the various circuit components.

At the upper left hand corner of the circuit drawing in FIG. 8 there are input terminals 124 and 125 which receive the signal from pressure transducer 108. The output from the complete circuit shown in FIG. 8 is through terminals 126 and 127 which connect to solenoid valve 97.

The first amplifier section 110 consists of integrated circuit unit IC1. The integrated circuit unit used is a TL085, although other suitable integrated circuit chips could be used. Resistors R2 and R3 are connected to pins 14 and 13 on chip IC1. Pin 11 is connected to receive 12 V. power. Pin 7 is grounded. Pin 14 is connected through resistor R4 to the output line from pin 12 on chip IC1. Pin 13 is connected through resistor R1 to receive 5 V. power.

The first amplifier section 110 is connected to second amplifier section 113 through resistor R6. Second amplifier section 113 includes a second integrated circuit chip IC1. Resistor R7 is connected between pin 1 and pin 3 of chip IC1. Pin 2 is connected to receive 5 V.

power. Pin 1 is connected through resistor R8 to adjustable potentiometer PR1 which is connected between a 10 V. power supply and ground. The output from second stage amplifier 113 is connected zero meter 115 which is connected through a resistor to receive 5 V. power.

Pin 3 from chip IC1 of second stage amplifier 113 is connected to switch 83 which switches between manual and automatic operation. The other side of switch 83 is connected to third stage amplifier 116 through adjustable potentiometer PR8. Adjustable potentiometer PR2 is connected between 10 V. power and ground and is connected through resistor R10 to pin 5 on integrated circuit chip IC1. Pin 6 is connected to receive 5 V. power. Resistor R9 is connected between pin 5 and pin 4 on chip IC1 of third stage amplifier 116.

The output from third stage amplifier (summer) 116 is connected to inverter 119 which includes integrated circuit chip IC2. Chip IC2 is a SK3569 chip although other chips performing the same function could be used. Chip IC2 has pin 8 connected to resistor R24 and has pin 9 connected to receive 5 V. power. Output pin 14 is connected to pin 8 through resistor R14. A 12 V. power source is connected through resistor R11 to pin 14 and through capacitor C2 to ground.

Pin 14 is connected through resistors R13 and R12 and rectifier diode D1, in parallel, to a line leading to on/off control circuit 120. Resistors R26 and R27 are connected in parallel and in series with rectifier diode D4 to off/on control circuit 118.

Oscillator 121 comprises an integrated circuit chip IC2. Pin 10 of chip IC2 is connected through capacitor C3 to receive power from a 5 V. source. Resistor R20 is connected to pin 11 and to resistor R19 connected to pin 13. Pin 3 is connected to a 10 V. power source and pin 12 is grounded. Resistor R21 is connected between pin 10 and pin 13. Resistor R22 and rectifier diode 5, in series, are connected in parallel with resistor R21.

The output from integrated circuit chip IC2 of oscillator 121 is connected to a point intermediate diodes 122 (D3) and 123 (D2). On/off circuit 120 comprises integrated circuit chip IC2 which has pin 4 connected to receive power from signal inverter 119. The line leading to pin 4 is connected to resistors R15 and R16 leading to a 10 V. power source and connected through capacitor C4 to ground. Pin 5 of chip IC2 is connected to receive 5 V. power supply. Pin 2 of unit 120 is connected to the base of transistor T2. Pin 2 is also connected through R30 to receive power from a 12 V. source. The collector of transistor T2 is connected through resistor R29 to the base of transistor T3. The collector of transistor T3 is connected to output connection 127 leading to one side of solenoid valve 97. The line leading to connection 127 is connected through rectifier diode D6 to ground.

Off/on circuit or power switch 118 comprises integrated circuit chip IC2 having pin 7 connected to receive power from a 5 V. power source. Pin 6 is connected to receive power from a 10 V. power source through resistors R18 and R25 and is connected through capacitor C5 to ground. The output pin 1 from chip IC2 is connected through resistor R31 to receive power from a 12 V. power source and is connected to the base of transistor T1. Transistor T1 has its collector connected to ground and its emitter connected through resistor R28 to the base of transistor T2. The collector of transistor T2 is connected to receive power from a 12 V. power source. The collector is connected to connection 126 for connection to the other side of solenoid valve 97. The line leading to connection 126 is connected through rectifier diode D7 to ground.

The circuit just described carries out the various successive amplification functions, inversion of signal, etc. for processing the signal from pressure transducer 108 and causing solenoid valve 97 to selectively apply compressed air to cylinder 37 to either apply additional braking force or to release the brake on the drum 26.

INSTALLATION AND OPERATION

The installation and operation of this control system should be apparent from the foregoing description but will be set forth in more detail to facilitate a fuller understanding of the invention.

The system is used with a conventional drilling rig having a bit weight indicator gauge on the console which responds to hydraulic pressure in a pressure sensor line leading from a pressure sensor mounted on the dead line. The console also has a drum brake which is operated by a handle, normally operated by the driller in the absence of an automatic controller.

The electronic control box 74 is installed on the driller's console 67. The pressure control box 73 is mounted beside the console 67. Fluid-operated cylinder 37 is mounted on base 70 and the free end 39 of piston 38 is secured to brake handle 34 to provide a positive movement of the brake handle by the piston. The line 36 from pressure sensor 35 is disconnected and a tee installed, to which the pressure transducer 108 is attached. The electric leads from pressure transducer 108 are connected to the electronic control box as previously described.

Drill control handle 85 is adjusted to set the brake to maintain an initially selected bit weight. Zero meter 78 is set by operation of adjustment knob 79. The indicator lights 80 and 81 signal whether the brake is on or off. The pressure transducer 108 responds to the same hydraulic pressure signal that is registered on the bit weight indicator gauge and so responds instantly to changes in bit weight.

As the drilling proceeds, variations in the composition and hardness of the formations being drilled will produce substantial changes in bit weight and will make the rate of drilling quite erratic. These variations can be controlled manually, but only with the greatest attention to controlling the brake in relation to the bit weight indicator. This control system accomplishes the control automatically.

When the bit weight increases, the signal from the pressure transducer is amplified and processed and actuates the on/off circuit 120 to actuate solenoid valve 97 to cause cylinder 37 to increase the brake force applied to drum 26. When the bit weight decreases, the signal from the pressure transducer is amplified and processed and actuates the on/off circuit 118 to actuate solenoid valve 97 to cause cylinder 37 to decrease the brake force applied to drum 26. Since the control circuits are electronic, the response to changes in bit weight are substantially instantaneous and a very rapid and positive control of the braking of the drum is accomplished.

The auxiliary control features are intermeshed with the main control functions so that overspeed switch 63 or trip valve or switch 64 can shut the rig down by dumping the air from the clutches and applying the brake. Likewise, a trip switch positioned adjacent to the crown block 28 can protect against a damaging impact by the traveling block 29 by dumping the air from the clutches and applying the brake. In the event of power failure or other failure of the components, the system fails with the brake on.

While this invention has been described fully and completely with special emphasis on two preferred embodiments, it should be understood that, within the scope of the appended claims, the invention may be practiced otherwise than as specifically described herein.

I claim:

1. An automatic drilling control system for a drilling apparatus having a rig with a crown block and a traveling block, a draw works including an engine, a drum powered by said engine, clutches, and controls, a drilling line wound on said drum and rolled up or fed out during drilling by said engine, said drilling line extending through said crown block and said traveling block and connected to a fixed point, the line portion from said crown block to said fixed point being the dead line, said crown block and traveling block forming a pulley system for supporting a drill pipe to raise or lower the same during drilling, a hydraulic pressure sensor connected to said dead line to measure the tension therein as drill pipe weight on the drill bit, a weight indicator gauge adjacent to said controls connected to said pressure sensor by a hydraulic line, and a brake, having a brake handle, controlling the rate of feed out of said drilling line to determine the tension on said dead line, said control system comprising a cylinder having a fluid-operated, double-acting piston with a free end connected to said brake handle for positively moving to increase or decrease the braking of said drum, means to supply pressurized fluid to said cylinder, a three-way electric solenoid valve having one fluid connection to said fluid supply means and separate fluid connections to opposite ends of said cylinder to moe said piston and positively operate said brake handle, and a pressure transducer connected to said hydraulic line and responsive to pressure therein as a measure of tension in said dead line, an electronic control circuit comprising amplifier means connected to receive an electric signal from said transducer, means for adjusting input to said amplifier means for adjusting the output thereof to select a pressure at which said solenoid valve will be actuated, first and second switching means connected to opposite sides of said solenoid valve, whereby a selected high pressure signal from said transducer will energize one side of said solenoid valve to operate said cylinder to increase braking force to said drum, and a selected lower pressure signal will energize the other side of said solenoid valve to operate said cylinder to decrease braking force applied to said drum to maintain a selected substantially constant tension in said dead line.

2. An automatic drilling control system according to claim 1 in which said switching means is responsive to predetermined high pressure and predetermined low pressure in said hydraulic line.

3. An automatic drilling control system according to claim 1 including means to select a pressure at which said electronic circuit actuates said solenoid valve, whereby the operation of said brake handle is controlled selectively to maintain a selected substantially constant tension in said dead line.

4. An automatic drilling control system according to claim 3 in which said selecting means is operable to select a range of pressures below which said solenoid valve is actuated for movement to one position applying pressure to one end of said cylinder and above which said solenoid valve is actuated for movement to another position applying pressure to the opposite end of said cylinder.

5. An automatic drilling control system according to claim 1 in which said amplifier means comprising a first amplifier connected to receive an electric signal from said transducer and a second amplifier in series with said first amplifier, said electronic control circuit further comprising a zero meter in series with said second amplifier, a first potentiometer for adjusting input to said second amplifier for setting said zero meter, a third amplifier in series with said second amplifier, a second potentiometer for adjusting input to said third amplifier for adjusting the output thereof to select a pressure at which said solenoid valve will be actuated, an oscillator and an inverter connected in parallel, in series with said third amplifier, said first and second switching means comprising first and second high/low transistor switching circuits connected in parallel, in series with said oscillator and said inverter, and one of said switching circuits being connected to one side of said solenoid valve and the other switching circuit being connected to the other side of said solenoid valve, whereby a selected high pressure signal from said transducer will energize one side of said solenoid valve to operate said cylinder to increase braking force to said drum, and a selected lower pressure signal will energize the other side of said solenoid valve to operate said cylinder to decrease braking force applied to said drum.

6. An automatic drilling control system according to claim 5 in which said electronic circuit includes a first switch means for energizing the same, and second switch means between said first and second amplifiers operable to deactivate the automatic operation of said solenoid valve.

7. An automatic drilling control system according to claim 5 in which said second and third amplifiers are summing amplifiers.

8. An automatic drilling control system according to claim 5 in which said one switching circuit comprises an NPN transistor and a PNP transistor, said NPN transistor having a grounded emitter and a resistor connecting its collector to the base of said PNP transistor, said PNP transistor having its emitter connected to power and its collector connected to one side of said solenoid valve, and an integrated circuit amplifier connected to the base of said NPN transistor, and said other switching circuit comprises an NPN transistor and a PNP transistor, said NPN transistor having a grounded emitter and a resistor connecting its collector to the base of said PNP transistor, said PNP transistor having its emitter connected to power and its collector connected to the other side of said solenoid valve, and an integrated circuit amplifier connected to the base of said NPN transistor.

9. Automatic drilling control apparatus for use on a drilling rig with a crown block and a traveling block, a draw works including an engine, a drum powered by said engine, clutches, and controls, a drilling line wound on said drum and rolled up or fed out during drilling by said engine, said drilling line extending through said crown block and said traveling block and connected to a fixed point, the line portion from said crown block to said fixed point being the dead line, said crown block and traveling block forming a pulley system for supporting a drill pipe to raise or lower the same during drilling, a hydraulic pressure sensor connected to said dead line to measure the tension therein as drill pipe weight on the drill bit, a weight indicator gauge adjacent to said controls connected to said pressure sensor by a hydraulic line, and a brake, having a brake handle, controlling the rate of feed out of said drilling line to determine the tension on said dead line, comprising a cylinder adapted to be positioned adjacent to a drilling console and having a fluid-operated, double-acting piston with a free end for connection to said brake handle for said drum brake for positively moving the handle to increase or decrease the braking of the drum, a three-way electric solenoid valve for connection adjacent to the drilling console and having one opening for fluid connection to a fluid supply means and separate openings for fluid connection to opposite ends of said cylinder to move said piston and positively operate said brake handle when assembled for operation, and a pressure transducer connected in said hydraulic line and responsive to pressure therein as a measure of bit weight, an electronic control circuit comprising amplifier means adapted to be connected to receive an electric signal from said transducer, means for adjusting input to said amplifier means for adjusting the output thereof to select a pressure at which said solenoid valve will be actuated, first and second switching means adapted to be connected to opposite sides of said solenoid valve, whereby a selected high pressure signal from said transducer, when assembled for use, will energize one side of said solenoid valve to operate said cylinder to increase braking force to said drum, and a selected lower pressure signal will energize the other side of said solenoid valve to operate said cylinder to decrease braking force applied to said drum to maintain a selected substantially constant tension in said dead line.

10. Automatic drilling control apparatus according to claim 9 in which said switching means is responsive to predetermined high pressure and predetermined low pressure in said hydraulic line.

11. Automatic drilling control apparatus according to claim 9 in which said switching means comprises transistor switch means responsive to predetermined high pressure and predetermined low pressure in said hydraulic line.

12. Automatic drilling control apparatus according to claim 9 in which said amplifier means comprising a first amplifier connected to receive an electric signal from said transducer and a second amplifier in series with said first amplifier, said electronic control circuit further comprising a zero meter in series with said second amplifier, a first potentiometer for adjusting input to said second amplifier for setting said zero meter, a third amplifier in series with said second amplifier, a second potentiometer for adjusting input to said third amplifier for adjusting the output thereof to select a pressure at which said solenoid valve will be actuated, an oscillator and an inverter connected in parallel, in series with said third amplifier, said first and second switching means comprising first and second high/low transistor switching circuits connected in parallel, in series with said oscillator and said inverter, and one of said switching circuits being adapted to be connected to one side of said solenoid valve and the other switching circuit being adapted to be connected to the other side of said solenoid valve, whereby a selected high pressure signal from said transducer will energize one side of said solenoid valve to operate said cylinder to increase braking force to said drum, and a selected lower pressure signal will energize the other side of said solenoid valve to operate said cylinder to decrease braking force applied to said drum.

13. Automatic drilling control apparatus according to claim 12 in which said electronic circuit includes a first switch means for energizing the same, and includes second switch means between said first and second amplifiers operable to deactivate the automatic operation of said solenoid valve.

14. Automatic drilling control apparatus according to claim 12 in which said second and third amplifiers are summing amplifiers.

15. Automatic drilling control apparatus according to claim 12 in which said one switching circuit comprises an NPN transistor and a PNP transistor;

said NPN transistor having a grounded emitter and a resistor connecting its collector to the base of said PNP transistor, said PNP transistor having its emitter adapted to be connected to power and its collector adapted to be connected to one side of said solenoid valve, and an integrated circuit amplifier connected to the base of said NPN transistor, and said other switching circuit comprises an NPN transistor and a PNP transistor, said NPN transistor having a grounded emitter and a resistor connecting its collector to the base of said PNP transistor, said PNP transistor having its emitter adapted to be connected to power and its collector adapted to be connected to the other side of said solenoid valve, and an integrated circuit amplifier connected to the base of said NPN transistor.

16. An electronic control circuit for an automatic drilling control apparatus for a drilling rig having a crown block and a traveling block, a draw works including an engine, a drum powered by said engine, clutches, and controls, a drilling line wound on said drum rolled up or fed out during drilling by said engine, said drilling line extending through said crown block and said traveling block and connected to a fixed point, the line portion from said crown block to said fixed point being the dead line, said crown block and traveling block forming a pulley system for supporting a drill pipe to raise or lower the same during drilling, a hydraulic pressure sensor connected to said dead line to measure the tension therein as drill pipe weight on the drill bit, a weight indicator gauge adjacent to said controls connected to said pressure sensor by a hydraulic line, a brake, having a brake handle, controlling the rate of feed out of said drilling line to determine the tension on said dead line, a pressure transducer connected in said hydraulic line to respond to pressure therein, a fluid operated cylinder and piston connected to operate said brake handle, and a solenoid valve for directing pressurized fluid selectively to one end or the other of said cylinder, said electronic control circuit comprising a first amplifier adapted to be connected to receive an electric signal from said pressure transducer to respond to pressure in said hydraulic line to energize said solenoid valve to operate said drum brake, a second amplifier in series with said first amplifier, a zero meter in series with said second amplifier, a first potentiometer for adjusting input to said second amplifier for setting said zero meter, a third amplifier in series with said second amplifier, a second potentiometer for adjusting input to said third amplifier for adjusting the output thereof to select a pressure at which said solenoid valve will be actuated, an oscillator and an inverter connected in parallel, in series with said third amplifier, first and second high/low transistor switching circuits connected in parallel, in series with said oscillator and said inverter, and one of said switching circuits being adapted to be connected to one side of said solenoid valve and the other switching circuit being adapted to be connected to the other side of said solenoid valve, whereby a selected high pressure signal from said transducer will energize one side of said solenoid valve to operate said cylinder to increase braking force to said drum, and a selected lower pressure signal will energize the other side of said solenoid valve to operate said cylinder to decrease braking force applied to said drum.

17. An electronic control circuit according to claim 16 including a first switch means for energizing the same, and second switch means between said first and second amplifiers operable to deactivate the automatic operation of said solenoid valve.

18. An electronic control circuit according to claim 16 in which said second and third amplifiers are summing amplifiers.

19. An electronic control circuit according to claim 16 in which said one switching circuit comprises an NPN transistor and a PNP transistor, said NPN transistor having a grounded emitter and a resistor connecting its collector to the base of said PNP transistor, said PNP transistor having its emitter connected to power and its collector adapted to be connected to one side of said solenoid valve, and an integrated circuit amplifier connected to the base of said NPN transistor, and said other switching circuit comprises an NPN transistor and a PNP transistor, said NPN transistor having a grounded emitter and a resistor connecting its collector to the base of said PNP transistor, said PNP transistor having its emitter connected to power and its collector adapted to be connected to the other side of said solenoid valve, and an integrated circuit amplifier connected to the base of said NPN transistor.

* * * * *